US007625599B2

(12) United States Patent
Huang et al.

(10) Patent No.: US 7,625,599 B2
(45) Date of Patent: Dec. 1, 2009

(54) METHOD AND APPARATUS FOR PREPARING POWDER CARRYING NANO GOLD BY THERMAL DECOMPOSITION

(75) Inventors: Dehuan Huang, 49 Showers Dr., N162, Mountain View, CA (US) 94040; Zongquan Li, Hangzhou (CN)

(73) Assignee: Dehuan Huang, Mountain View, CA (US)

( * ) Notice: Subject to any disclaimer, the term of this patent is extended or adjusted under 35 U.S.C. 154(b) by 864 days.

(21) Appl. No.: 11/206,048

(22) Filed: Aug. 18, 2005

(65) Prior Publication Data

US 2007/0042116 A1 Feb. 22, 2007

(51) Int. Cl.
*B05D 7/00* (2006.01)
*B05D 3/02* (2006.01)

(52) U.S. Cl. ..... 427/212; 427/215; 427/226; 427/229

(58) Field of Classification Search ..... 427/212, 427/215, 226, 229
See application file for complete search history.

(56) References Cited

U.S. PATENT DOCUMENTS 4,438,082 A * 3/1984 Dettling et al. ..... 423/235
4,698,324 A * 10/1987 Haruta et al. ..... 502/243
4,971,944 A * 11/1990 Charles et al. ..... 505/470

* cited by examiner

*Primary Examiner*—Michael Cleveland
*Assistant Examiner*—Robert Vetere
(74) *Attorney, Agent, or Firm*—Rosenberg, Klein & Lee

(57) ABSTRACT

Disclosed is a method for preparing powder carrying nano gold by thermal decomposition, comprising the steps of: (1) providing a nano powder of artificial synthesized material or a natural mineral powder which particle size is in nano to micro scale as a carrier, preparing 0.2-5.0% (weight percentage concentration) gold bromide solution with deionized water and gold bromide, adding the carrier into the gold bromide solution, and a weight ratio of gold bromide and carrier is 1:1-1:1000, immersing the carrier into the solution for 0.5-4 hours in dark; (2) drying the immersed carrier and the solution at 50-90° C., and grinding the carrier to the fine mixed powders; and (3) heating the mixed powders obtained in step (2) at 200-350° C. for 0.5-3 hours in a heating apparatus flown argon gas or air at a flow rate of 1-10 L/min, and obtaining the carrier powder carrying nano gold after decreasing the heating temperature to room temperature under continuous air flow. The advantages of present invention includes: (1) it is a simple process, low cost, (2) there are no dispersant agent and surfactant in the product, and (3) there are no poisonous or harmful materials are excluded in the preparation process.

3 Claims, 4 Drawing Sheets

METHOD AND APPARATUS FOR PREPARING POWDER CARRYING NANO GOLD BY THERMAL DECOMPOSITION

BACKGROUND OF THE INVENTION

1. Field of the Invention

The present invention relates to a method and an apparatus for preparing powder carrying nano gold by thermal decomposition.

2. The Prior Arts

Nano gold draws a great attention because it can be widely applied in the fields of medicine, health, biochemical engineering, and catalyst for air cleaning. Currently, reduction method is a mainly method to prepare nano gold. In order to obtain dispersed nano gold particles, dispersant agents and surfactants which may be harmful to human body are usually used in the preparation process of reduction method. Moreover, the product prepared by reduction method is a nano gold solution, which contains less gold particles, and it is difficult to industrialize because the nano gold particles have to be isolated from a solution of large volume. Besides, pure nano gold powder is easy to agglomerate and is not convenient to use. Dispersion and application of nano gold will become easier if some inorganic material or natural mineral is used as a carrier to attach nano gold to prepare a carrier powder carrying nano gold.

SUMMARY OF THE INVENTION

An object of the present invention is to provide a method and an apparatus for preparing a powder carrying nano gold powder by thermal decomposition.

The method for preparing a powder carrying nano gold by thermal decomposition comprises the steps of:

(1) providing a nano powder of artificial synthesized material or a natural mineral powder of which particle size is in nano to micro scale as a carrier, preparing 0.2-5.0% (weight percentage concentration) gold bromide solution with deionized water and gold bromide, adding the carrier into the gold bromide solution and a weight ratio of gold bromide and carrier is 1:1-1:1000, and immersing the carrier into the solution for 0.5-4 hours in dark;

(2) drying the immersed carrier and the solution at 50-90° C., grinding the carrier to be the fine mixed powders; and (3) heating the powders obtained from step (2) at 200-350° C. for 0.5-3 hours in a heating apparatus flown argon gas or air at a flow rate of 1-10 L/min, and obtaining the powders carrying nano gold after decreasing the heating temperature to room temperature under continuous gas flowing.

The aforementioned artificial synthesized materials may be n-SiO2, n-TiO2, n-CaCO3, n-Al2O3, or n-ZnO. The natural mineral powder may be powder of palygorskite, sepiolite, kaolinite, or montmorillonite.

An apparatus for preparing powders carrying nano gold by thermal decomposition comprises a furnace body, a reactor, which is consisted of quartz tube and ceramic floater, is positioned in the furnace body, and the ceramic floater is positioned in the quartz tube, the quartz tube have a gas flowing entrance in one end and an exit tube in another end, the exit tube is sequentially connected with a container for metal powder and a container for ethanol, and the metal powder and ethanol are used to absorb bromine which is released from decomposition of gold bromide; wherein, the metal powder may be iron powder, copper powder, or aluminum powder.

The present invention provides various powders carrying nano gold by means of the gold bromide properties of poor stability and decomposability in low temperature to obtain nano gold, and simultaneously allows the nano gold to be carried onto the artificial synthesized material powder having large surface area and stable structure, or the natural mineral powder having nano structure and being superior in absorbing gold particles to nano pores, surface area, and dispersion. The size of nano gold particles obtained is 10-150 nm, and the nano gold particles are uniformly distributed in the carriers. The advantages of present invention include that (a) it is a simple process, low cost, (2) there are no dispersant agent and surfactant used in the product, and (3) there are no poisonous or harmful materials are excluded in the preparation process.

DETAILED DESCRIPTION OF THE PREFERRED EMBODIMENT

Figure 1:
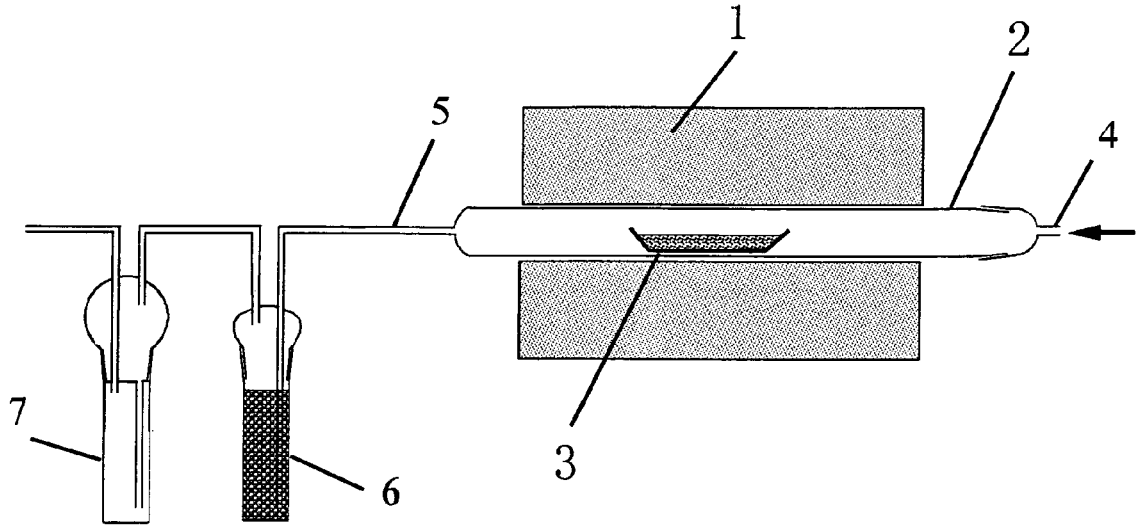
FIG. 1 illustrates an apparatus for preparing a powder carrying nano gold by thermal decomposition.

Referring to FIG. 1, an apparatus for preparing a powder carrying nano gold by thermal decomposition comprises a furnace body 1, an reactor, which is consisted of quartz tube 2 and ceramic floater 3, the quartz tube and the ceramic floater are positioned in the furnace body, the ceramic floater 3 is positioned in the quartz tube 2, the quartz tube have a gas flowing entrance 4 in one end and an exit tube 5 in another end, the exit tube is sequentially connected with a container 6 for metal powder and a container 7 for ethanol, and the metal powder and ethanol are used to absorb bromine which is released from decomposition of gold bromide.

EXAMPLE 1

(1) Preparing 1.0% (weight percentage concentration) of gold bromide solution with deionized water;

(2) Adding 2 g of artificial synthesized n-SiO2 powder into 5.8 ml of gold bromide solution, and making the solution 20 ml with water, the n-SiO2 powder being immersed in the solution for 0.5 hours in dark;

(3) Drying the carrier and the solution after immersion at 80° C. and grinding the carrier to the fine mixed powders;

(4) Putting the powders obtained into a ceramic floater in the heating apparatus, and heating the mixed powders at 200° C. for 1 hour under an argon gas flowing of 2 L/min and obtaining the powder carrying 1.3% of nano gold after decreasing the heating temperature to room temperature under continuous air flow.

Figure 2:
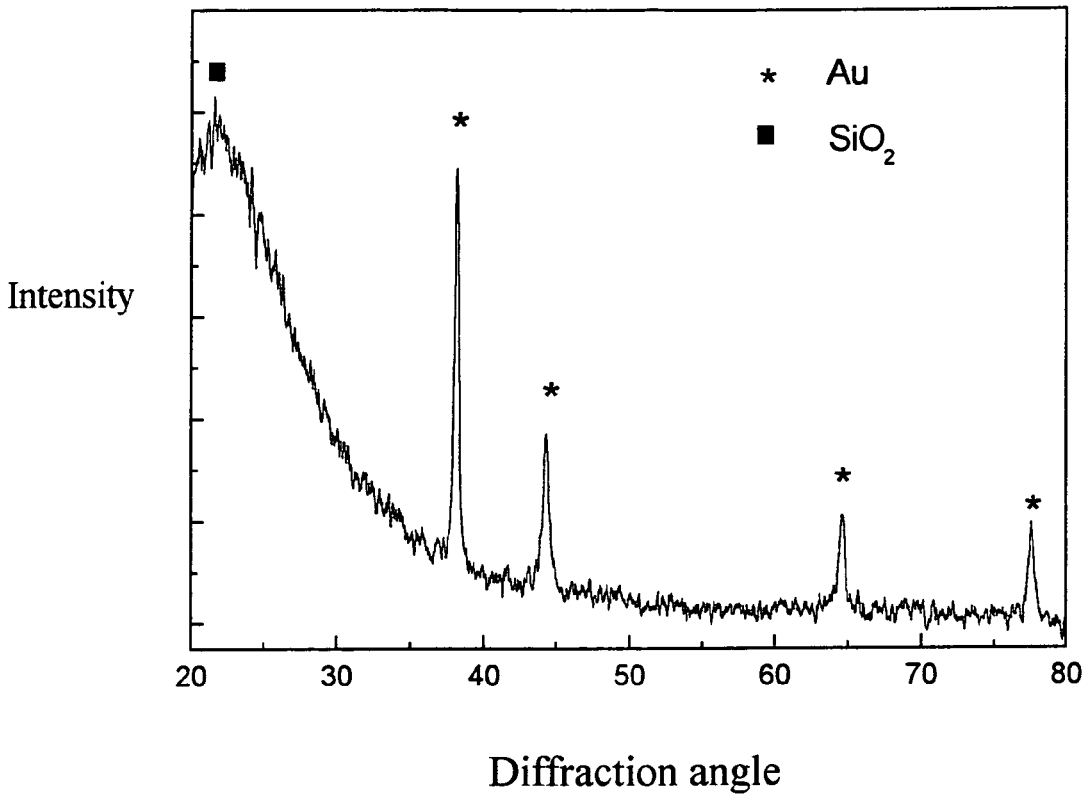
FIG. 2 shows an X-ray diffraction pattern of SiO2 powder carrying nano gold according to Example 1, wherein the gold contained in the power is 1.3%, symbol "*" represents the diffraction peaks of gold, and the average size of gold particle is 45 nm.

FIG. 2 shows the X-ray diffraction pattern of the SiO2 powder carrying nano gold. The powder consists of SiO2 and gold. The symbol "*" represents the diffraction peaks of gold, and the average size of gold particles is 45 nm.

EXAMPLE 2

(1) Preparing 1.0% (weight percentage concentration) of gold bromide solution with deionized water;

(2) Adding 2 g of artificial synthesized n-SiO2 powder into 23.4 ml of gold bromide solution, the n-SiO2 powder being immersed in the solution for 0.5 hours in dark;

(3) Drying the carrier and the solution after immersion at 80° C. and grinding the carrier to fine mixed powders;

(4) Putting the powders obtained into a ceramic floater in the heating apparatus, and heating the mixed powders at 300° C. for 0.5 hours under an argon gas flowing of 3 L/min, and obtaining the powder carrying 5.0% of nano gold after decreasing the heating temperature to room temperature under continuous air flow.

Figure 3:
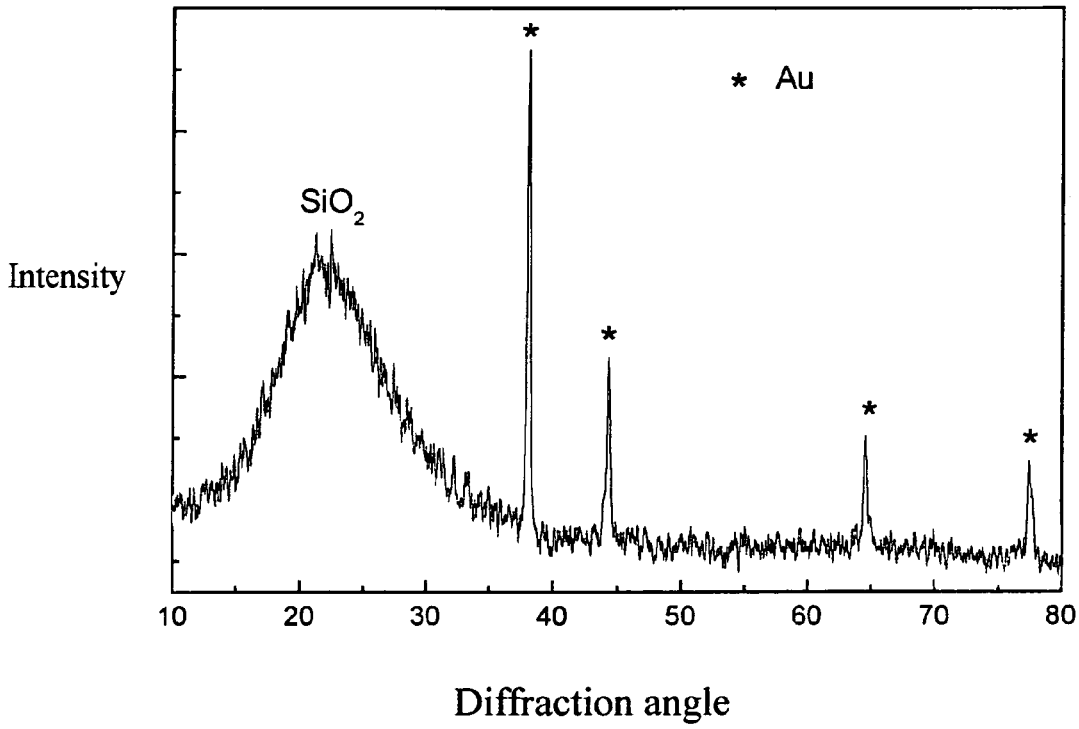
FIG. 3 shows an X-ray diffraction pattern of SiO2 powder carrying nano gold according to Example 2, wherein the gold contained in the power is 5.0%, symbol "*" represents the diffraction peaks of gold, and the average size of gold particle is 105 nm.

FIG. 3 shows the X-ray diffraction pattern of the SiO2 powder carrying nano gold, wherein the powder consists of SiO2 and gold, the symbol "*" represents the diffraction peaks of gold, and the average size of gold particles is 105 nm.

EXAMPLE 3

(1) Preparing 1.0% (weight percentage concentration) of gold bromide solution with deionized water;

(2) Adding 2 g of artificial synthesized n-TiO2 powder into 8.9 ml of gold bromide solution, and making the solution 20 ml with water, the n-TiO2 powder being immersed in the solution for 0.5 hours in dark;

(3) Drying the carrier and the solution after immersion at 85° C. and grinding the carrier to fine mixed powders;

(4) Putting the powders obtained into a ceramic floater in the heating apparatus, and heating the mixed powder at 300° C. for one hour under argon gas flowing of 2 L/min, and obtaining the TiO2 powder carrying 2.0% of nano gold after decreasing the heating temperature to room temperature under continuous air flow.

Figure 4:
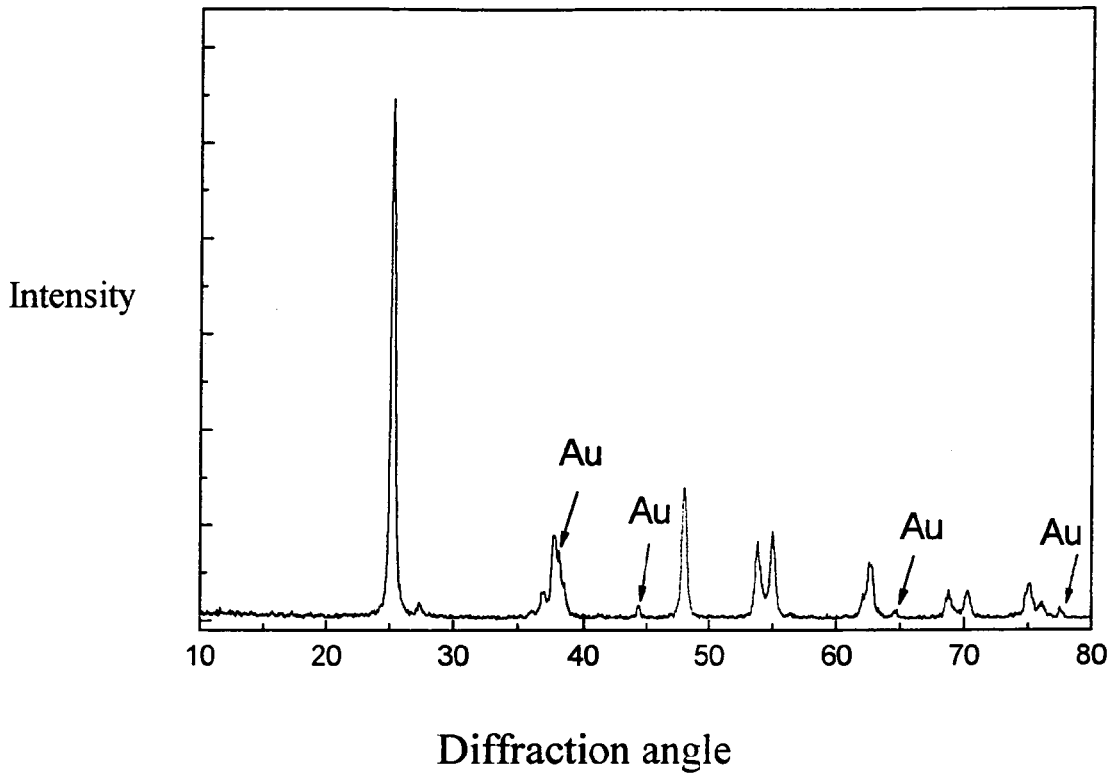
FIG. 4 shows an X-ray diffraction pattern of TiO2 powder carrying nano gold according to Example 3, wherein the gold contained in the power is 2.0%, arrows point out the diffraction peaks of gold, other diffraction peaks are TiO2, and the average size of gold particle is 100 nm.

FIG. 4 shows the X-ray diffraction pattern of the TiO2 powder carrying nano gold. Arrows in the figure point out the diffraction peaks of gold, and the average size of gold particles is 100 nm.

EXAMPLE 4

(1) Preparing 1.0% (weight percentage concentration) of gold bromide solution with deionized water;

(2) Adding 20 g of micro-scale palygorskite powder into 10 ml of gold bromide solution, and making the solution 40 ml with water, the palygorskite powder being immersed in the solution for one hour in dark;

(3) Drying the carrier and the solution after immersion at 70° C. and grinding the carrier to the fine mixed powders;

(4) Putting the powders obtained into a ceramic floater in heating apparatus, and heating the mixed powders at 350° C. for one hour under an argon gas flowing of 1 L/min, and obtaining the palygorskite powder carrying 0.22% of nano gold after decreasing the heating temperature to room temperature under continuous air flow, wherein the average size of gold particles is 80 nm.

EXAMPLE 5

(1) Preparing 2.0% (weight percentage concentration) of gold bromide solution with deionized water;

(2) Adding 1 g of micro-scale sepiolite powder into 20 ml of gold bromide solution, the powder being immersed in the solution for three hours in dark;

(3) Drying the carrier and the solution after immersion at 80° C. and grinding the carrier to the fine mixed powders;

(4) Putting the powders obtained into a ceramic floater in the heating apparatus, and heating the mixed powders at 250° C. for one hour under an argon gas flowing of 5 L/min, and obtaining the sepiolite powder carrying 15.3% of nano gold after decreasing the heating temperature to room temperature under continuous air flow, wherein the average size of gold particles is 110 nm.

EXAMPLE 6

(1) Preparing 5.0% (weight percentage concentration) of gold bromide solution with deionized water;

(2) Adding 1 g of micro-scale palygorskite powder into 20 ml of gold bromide solution, the palygorskite powder being immersed in the solution for three hours in dark;

(3) Drying the carrier and the solution after immersion at 85° C. and grinding the carrier to the fine mixed powders;

(4) Putting the powders obtained into a ceramic floater in the heating apparatus, and heating the mixed powders at 300° C. for one hour under an argon gas flowing of 8 L/min, and obtaining the palygorskite powder carrying 31.0% of nano gold after decreasing the heating temperature to room temperature under continuous air flow, wherein the average size of gold particles is 120 nm.

What is claimed is:

1. A method for preparing a powder carrying nano gold by thermal decomposition, comprising the steps of:

(1) providing, as a carrier, a nano powder of artificial synthesized powder or a natural mineral powder of nano to micro scale particle size, preparing 0.2-5.0% (weight percentage concentration) gold bromide solution with deionized water and gold bromide, adding the carrier into the gold bromide solution, and a weight ratio of gold bromide and carrier is 1:1-1:1000, immersing the carrier into the solution for 0.5-4 hours in dark;

(2) drying the immersed carrier and the solution at 50-90° C., and grinding the carrier to the fine mixed powders; and (3) heating the mixed powders obtained in step (2) at 200-350° C. for 0.5-3 hours in a heating apparatus flown argon gas or air at a flow rate of 1-10 L/min, and obtaining the powder carrying nano gold after decreasing the heating temperature to room temperature under continuous air flow.

2. The method as claimed in claim 1, wherein the artificial synthesized material is selected from the group consisting of n-SiO2, n-TiO2, n-CaCO3, n-Al2O3, and n-ZnO.

3. The method as claimed in claim 1, wherein the natural mineral powder is selected from the group consisting of palygorskite, sepiolite, kaolinite, and montmorillonite.

* * * * *

UNITED STATES PATENT AND TRADEMARK OFFICE

CERTIFICATE OF CORRECTION

PATENT NO. : 7,625,599 B2
APPLICATION NO. : 11/206048
DATED : December 1, 2009
INVENTOR(S) : Huang et al.

It is certified that error appears in the above-identified patent and that said Letters Patent is hereby corrected as shown below:

In the Title Page, Item [73] delete the name "Dehuan Huang" and insert --Shanghai Applied Nanotechnologies Co., Ltd.--

Signed and Sealed this
Twenty-eighth Day of December, 2010

David J. Kappos

David J. Kappos
*Director of the United States Patent and Trademark Office*